US007296758B2

(12) United States Patent
Zhou

(10) Patent No.: US 7,296,758 B2
(45) Date of Patent: Nov. 20, 2007

(54) AUTOMATIC LIFT FAUCET

(76) Inventor: Huasong Zhou, Rm 704, #135, Hubin S. Road, Xiamen, Fujian (CN)

( * ) Notice: Subject to any disclaimer, the term of this patent is extended or adjusted under 35 U.S.C. 154(b) by 0 days.

(21) Appl. No.: 11/419,032

(22) Filed: May 18, 2006

(65) Prior Publication Data

US 2007/0169472 A1 Jul. 26, 2007

(30) Foreign Application Priority Data

Jan. 25, 2006 (CN) ..... 2006 1 0033398

(51) Int. Cl.

| | |
|---|---|
| ***B05B 15/10*** | (2006.01) |
| ***B05B 15/06*** | (2006.01) |
| ***E03C 1/04*** | (2006.01) |
| ***F16K 21/00*** | (2006.01) |

(52) U.S. Cl. ..... 239/200; 239/201; 239/203; 239/204; 137/801; 4/678

(58) Field of Classification Search ..... 239/200, 239/201, 203, 204, 16, 17, 24, 28, 124, 126, 239/202, 205, 208, 537, 541, 569, 570, 571; 137/801; 4/678, 675

See application file for complete search history.

(56) References Cited

U.S. PATENT DOCUMENTS

| | | | | |
|---|---|---|---|---|
| 2,903,710 | A * | 9/1959 | Pearson | 4/568 |
| 2,997,722 | A * | 8/1961 | Pearson | 4/570 |
| 4,457,342 | A * | 7/1984 | Moen | 137/801 |
| 7,108,011 | B1 * | 9/2006 | Lordahl et al. | 137/625.17 |
| 2005/0178452 | A1 * | 8/2005 | Vilhelmsen | 137/801 |

* cited by examiner

*Primary Examiner*—Darren Gorman
(74) *Attorney, Agent, or Firm*—Banger Shia

(57) ABSTRACT

An automatic lift faucet includes a hydraulic cylinder vertically mounted under a working top, the hydraulic cylinder having an inlet. A lifting faucet is mounted in motion fitting connection within the hydraulic cylinder and includes an inlet and a faucet outlet. A lifting piston is attached to the lifting faucet for controlling fluid communication between the hydraulic cylinder and the lifting faucet inlet. An accumulator cylinder is mounted to the bottom end of the lifting faucet and includes a baffle-plate, a valve stern and left and right tow pistons to thereby divide the accumulator cylinder into three sub-chambers. The accumulator cylinder also includes three through-holes, one of each communicating with one of each of the three sub-chambers. A pressure release valve selectively controls fluid communication to the through-holes and to the hydraulic cylinder inlet via first and second branch pipes.

2 Claims, 5 Drawing Sheets

AUTOMATIC LIFT FAUCET

BACKGROUND OF THE INVENTION

1. Field of the Invention

The present invention relates to a faucet, and more particularly to an automatic lift faucet that can hide under the working top in idle time.

2. Description of Prior Art

In accordance with the conventional technology, the most of the structure of the faucet located on the side of the kitchen sink occupies big space, especially nearing the window, even affect to open the window.

This is the sake of discovering the present invention.

OBJECTS AND SUMMARY OF THE INVENTION

It is therefore a main object of the present invention to provide an automatic lift faucet that can hide under the working top in the idle time, only lift out in use time so as to save space efficiently.

For achieving the above-mentioned object, the present invention provides an automatic lift faucet that is typically comprised of a hydraulic cylinder, a lifting faucet, a lifting piston, a pressure release valve and an accumulator cylinder; wherein said hydraulic cylinder has a through-hole penetrating the both ends axially, and a inlet approaching to the low end, and is vertically mounted under the working top; said lifting faucet has an outlet at top end, and a closed bottom end, and an inlet built on the middle portion, and is mounted at the inside of the hydraulic cylinder in motion fitting connection, and is attached with a balance weight at the bottom side; said lifting piston is located on the lifting faucet coordinating to the inlet, and is attached with a pressure valve and a restoring spring for controlling the inlet communicating to the hydraulic cylinder or not; said accumulator cylinder mounted below the working top horizontally has a center baffle-plate built on the center having a central hole levelly for a valve stem fitting in, and said valve stem is attached with tow pistons fixed on the both ends respectively and crossly to divide the inside of the accumulator cylinder into three accumulator sub-chambers, such as the left end of the accumulator cylinder and the left piston surround the first accumulator sub-chamber, the left piston and the center baffle-plate construct the second sub-chamber, and the right piston and the right end of the accumulator cylinder form the third sub-chamber, coordinating to the three sub-chambers, said accumulator cylinder has three through-holes drilled on left end, middle portion and the right end respectively on the trunk communicating to said three sub-chambers individually; one branch pipe of the inlet pipe is connected to the first through-hole, and one other branch pipe is indirectly connected to the second and third through-holes, and the inlet of the hydraulic cylinder via said pressure release valve respectively.

Said balance weight of the lifting faucet is the accumulator cylinder fixed on bottom end of said lifting faucet.

As utilizing above-mentioned project, the present invention is mounted in place with full accumulator cylinder and hydraulic cylinder, in this time the three sub-chambers are filled water. When cutting off the inlet pipe, the pistons of said accumulator cylinder are in static without any motion, said lifting faucet is pulled down by said full accumulator cylinder working as the balance weight until to get the lowest point hiding into the working top, such as home position.

When cutting on the inlet pipe, in the hydraulic cylinder, the water pressure exerting on the lifting piston is increased so as to be bigger than the sum of the weight and the friction of the lifting faucet, so the lifting piston goes up under the water pressure to lift the faucet rising from the working top gradually, but in this time, the pressure valve blocks the inlet to communicate with the hydraulic cylinder under the restoring spring and the water pressure, so the faucet is closed without water flowing out; on the other hand, in the accumulator cylinder, the sum of the leftward pressure exerting on left sides of the pistons in the second and the third accumulator sub-chambers is equal to the sum of the rightward pressure exerting on the right side of the left piston in the first accumulator sub-chamber and the friction and other contacting reaction forces, such as the valve stem is in balance, so it stays in the original position.

When the lifting piston going up is stopped on the tip end of the hydraulic cylinder, in the hydraulic cylinder, said faucet is lifted to expose above the working top by the lifting piston driven by the water pressure overcoming the sum of the weight, friction and all resistance forces until the pressure valve touches against the top end of the hydraulic cylinder overcoming the sum of the water pressure and the spring force to press down the restoring spring, so as to allow the inlet communicating to the hydraulic cylinder, in this time the water in the hydraulic cylinder is led into the faucet, and spray out from the outlet of the faucet facilitating to using, in this time the pressure release valve is in action, the pressure in the water line is changed; and in the accumulator cylinder, because the water in the second and the third accumulator sub-chambers flows to the faucet via the hydraulic cylinder, so sum of the leftward pressures exerting on the right sides of the left and right pistons in the second and third accumulator cylinders is less than the rightward pressure exerting on the left side of the left piston in the first accumulator sub-chamber, so the balance is broken off, the pistons are moved to the right to assist water in the second and third accumulator cylinders with draining out until running out.

When turning off the gate of the inlet pipe, in the hydraulic cylinder, the water pressure exerting on the lifting piston and the friction are less than the owning weight, so the lifting facet goes down under the weight force automatically until fully hiding under the working top; during going down, when the pressure valve is departed with the top end of the hydraulic cylinder, it is pushed up by the restoring spring to block the inlet to communicate to the hydraulic cylinder again, so the faucet is cut off without water flowing out; in this time, the water at inside of the hydraulic cylinder is pushed into the second and the third accumulator sub-chambers, in the accumulator cylinder, the increased water pressures in the second and the third accumulator sub-chambers push the left and right pistons leftward as it is bigger than sum of the water pressure in the first accumulator sub-chamber rightward and other rightward extra forces, so that the first accumulator sub-chamber starts to drain water, the drained water from the first accumulator sub-chamber is led into the second and the third accumulator sub-chambers via the pressure release valve, and they are accumulated water until the lifting faucet gets into the home position, the all system is gone back to the original state.

Therefore, by means of the hydraulic cylinder, the accumulator cylinder, the pressure release valve and water pressure, the faucet hidden under the working top provided by the present invention can carry out automatic lifting up and falling down, so as to get in lifting up in using time, and falling down in idle time functions, not only facilitating to using, but also saving occupied space. Additionally, water in the whole system is circled without any pollution occurred.

DETAILED DESCRIPTION OF PREFERRED EMBODIMENTS

Figure 1:
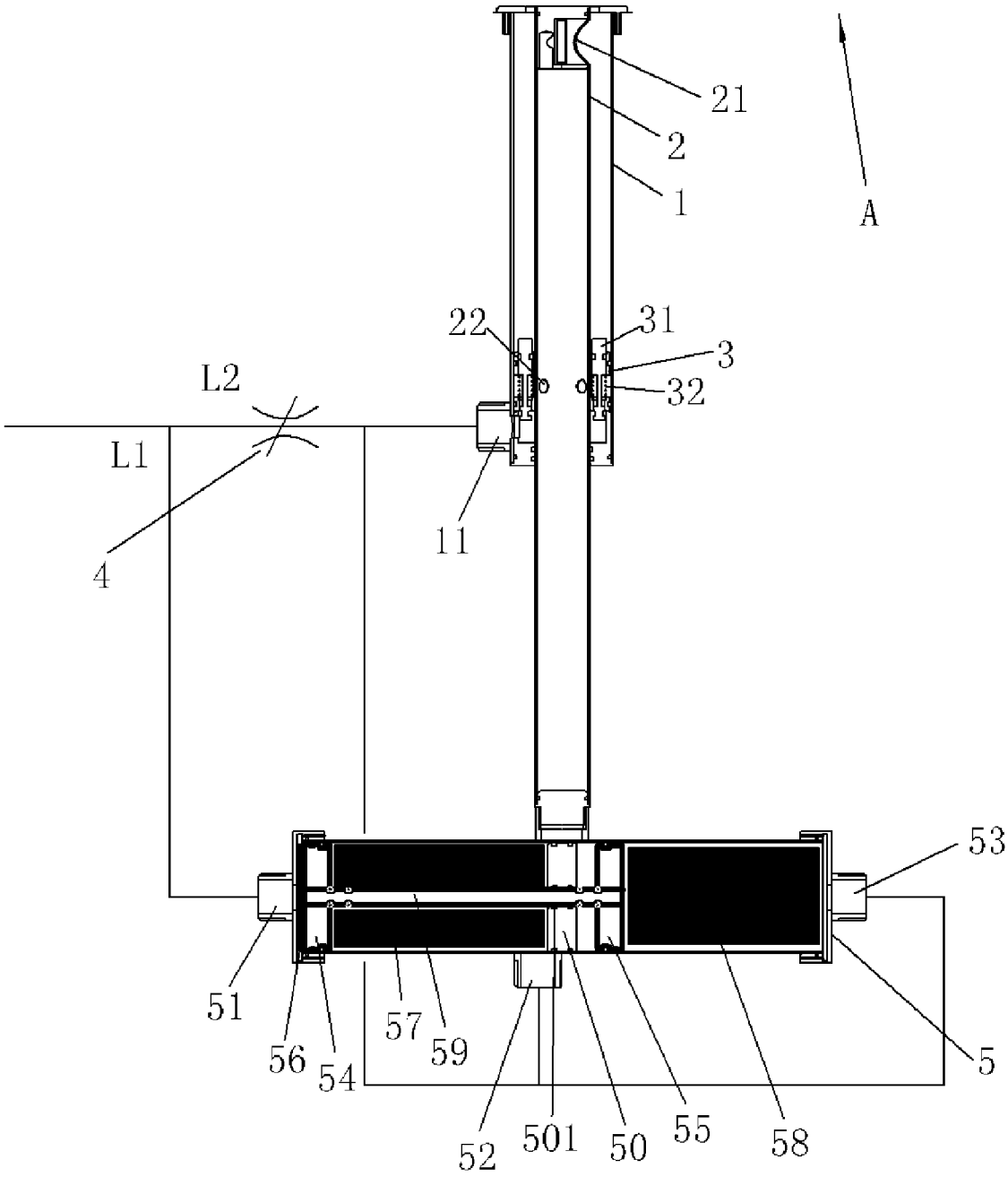
FIG. 1 is a cross-section view showing the original state of the present invention.

Referring to FIG. 1, an automatic lift faucet discovered by the present invention is typically comprised of a hydraulic cylinder 1, a lifting faucet 2, a lifting piston 3, a pressure release valve 4 and an accumulator cylinder 5.

Wherein, said hydraulic cylinder 1 has a through-hole penetrating the both ends axially, and an inlet 11 approaching to the low end, and is vertically mounted under the working top A.

Said lifting faucet 2 has an outlet 21 at top end, and a closed bottom end, and an inlet 22 built on the middle portion, and is mounted at the inside of the hydraulic cylinder 1 in motion fitting connection up-down, and is attached with a balance weight at the bottom side used for drawing the faucet down under the weight force, which can be an absolute balance weight or other component used as a balance weight, in this embodiment of the present invention takes the accumulator cylinder 5 as the balance weight fixed on the bottom end of the lifting faucet 2.

Said lifting piston 3 is located on the lifting faucet 2 coordinating to the inlet 22, and is attached with a pressure valve 31 and a restoring spring 32 for cooperatively controlling the inlet 22 communicating to the hydraulic cylinder 1 or not. When an extra force pressed said pressure valve 31 moving down overcoming the restoring force of the restoring spring 32, the inlet 22 is opened to communicate to the hydraulic cylinder, when said extra force is eliminated from the pressure valve 31, said pressure valve 31 is pushed up under the restoring force coming from the restoring spring 32 to block off the inlet 22 again not to communicate to the hydraulic cylinder 1.

Said accumulator cylinder 5 mounted below the working top A horizontally has a center baffle-plate 50 built on the center having a central hole 501 levelly for a valve stem 59 fitting in, and said valve stem 59 is attached with tow pistons 54 55 fixed on the both ends respectively and crossly to divide the inside of the accumulator cylinder 5 into three accumulator sub-chambers, such as the left end of the accumulator cylinder 5 and the left piston 54 surround the first accumulator sub-chamber 56, the left piston 54 and the center baffle-plate 50 construct the second sub-chamber 57, and the right piston 55 and the right end of the accumulator cylinder 5 form the third sub-chamber 58, coordinating to the three sub-chambers 56 57 58, said accumulator cylinder 5 has three through-holes 51 52 53 drilled on left end, middle portion and the right end respectively on the trunk communicating to said three sub-chambers individually.

One branch pipe L1 of the inlet pipe is connected to the first through-hole 51, and one other branch pipe L2 is indirectly connected to the second and third through-holes 52 53, and the inlet 11 of the hydraulic cylinder 1 via said pressure release valve 4 respectively.

The present invention is mounted in place with full accumulator cylinder 5 and hydraulic cylinder 1, as shown in FIG. 1, in this time the three sub-chambers 56 57 58 and the hydraulic cylinder 1 are filled water. When cutting off the inlet pipe, the pistons 54 55 of said accumulator cylinder 5 are in static without any motion, said lifting faucet 2 is pulled down by said full accumulator cylinder 5 working as the balance weight until to get the lowest point hiding into the working top A, such as home position.

Figure 2:
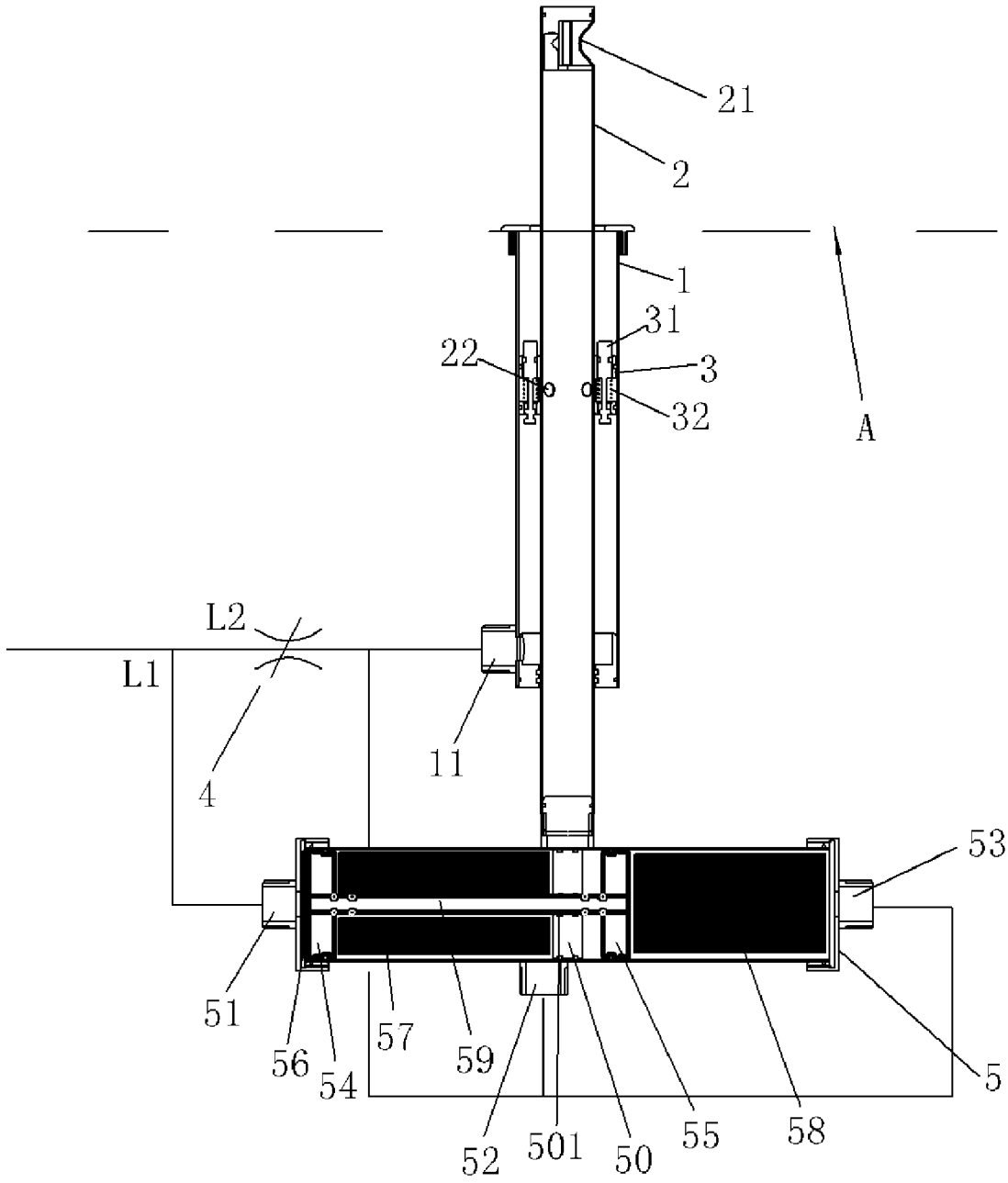
FIG. 2 is a cross-section view showing the lifting state of the present invention.

As tending to use, as shown in FIG. 2, when cutting on the inlet pipe, in the hydraulic cylinder 1, the water pressure exerting on the lifting piston 3 is increased so as to be bigger than the sum of the weight (including the weights of the lifting faucet 2 and the lifting piston 3, and the accumulator cylinder 5 at here and below unless otherwise noted) and the frictions, so the lifting piston 3 goes up under the water pressure to lift the faucet 2 rising from the working top A gradually, but in this time, the pressure valve 31 blocks the inlet 22 to communicate with the hydraulic cylinder 1 under the restoring spring 32 and the water pressure, so the faucet 2 is closed without water flowing out; on the other hand, in the accumulator cylinder 5, the sum of the leftward pressure exerting on left sides of the pistons 54 55 in the second and the third accumulator sub-chambers 57 58 is equal to the sum of the rightward pressure exerting on the right side of the left piston 54 in the first accumulator sub-chamber 56 and the friction and other contacting reaction forces, such as the valve stem 59 is in balance, so it stays in the original position.

Figure 3:
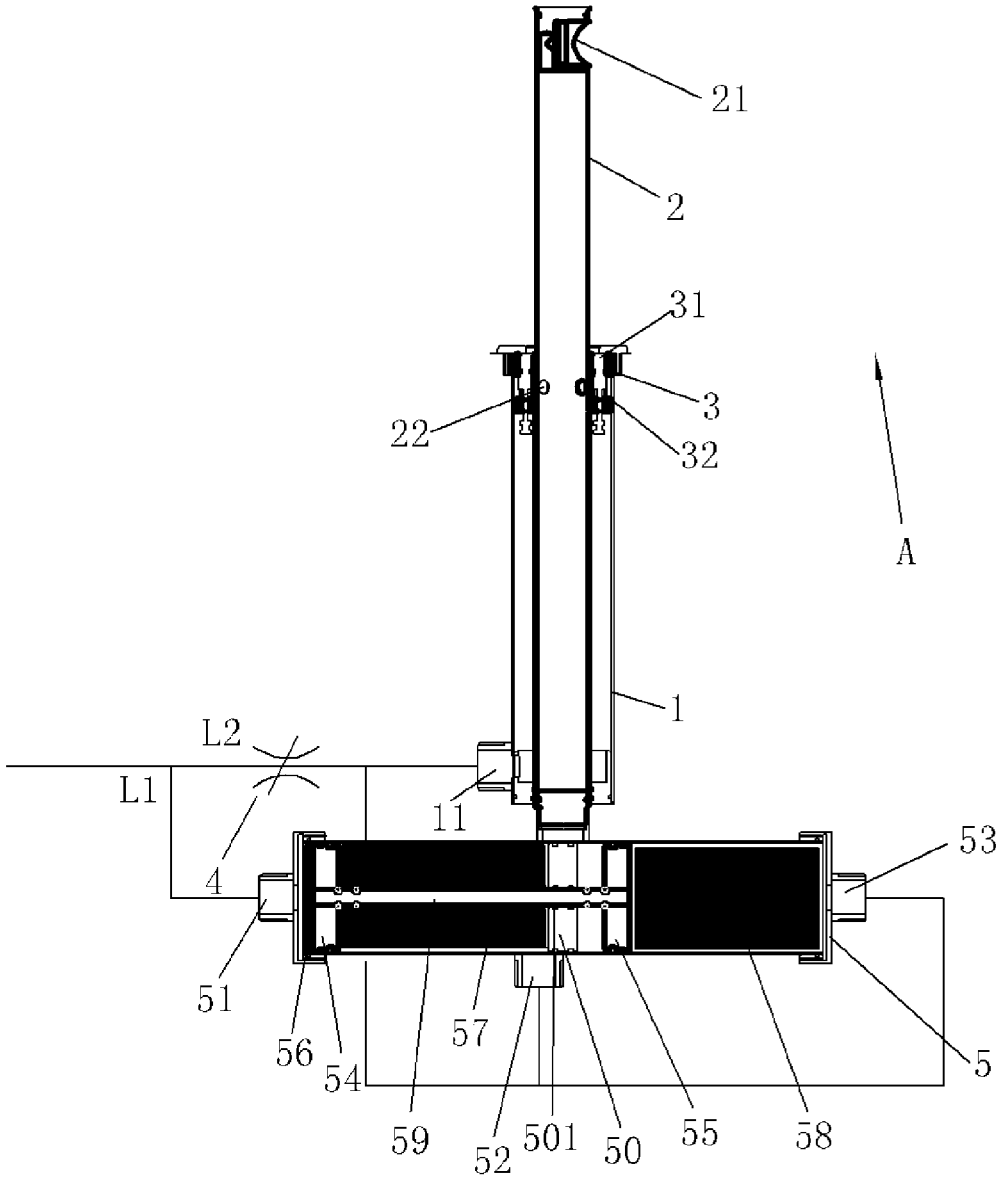
FIG. 3 is a cross-section view showing the getting top end state of the present invention.

Referring to FIG. 3, when the lifting piston 3 going up is stopped on the tip end of the hydraulic cylinder 1, in the hydraulic cylinder 1, said faucet 2 is lifted completely to expose above the working top A by the lifting piston 3 driven by the water pressure overcoming the sum of the weight, friction and all resistance forces until the pressure valve 31 touches against the top end of the hydraulic cylinder 1 overcoming the sum of the water pressure and the spring force to press down the restoring spring 32, so as to allow the inlet 22 communicating to the hydraulic cylinder 1, in this time the water in the hydraulic cylinder 1 is led into the faucet 2, and spray out from the outlet 21 of the faucet 2 facilitating to using, in this time the pressure release valve 4 is in action, the pressure in the water line is changed.

Figure 4:
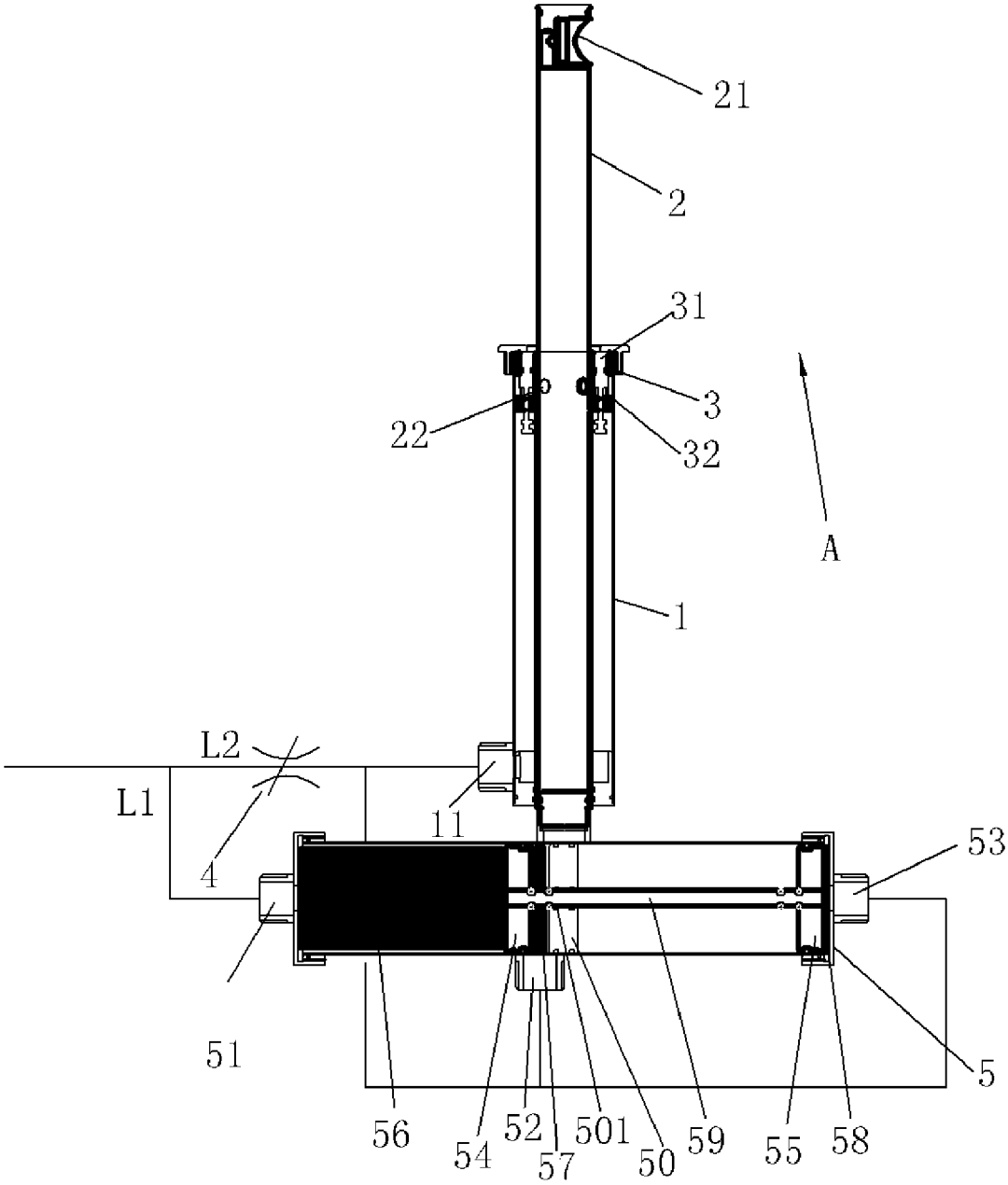
FIG. 4 is a cross-section view showing the faucet spraying water out state of the present invention.

Cooperating to FIG. 4 in reference, during the faucet 2 sprays out water, in the accumulator cylinder 1, because the water in the second and the third accumulator sub-chambers 57 58 flows to the faucet 2 via the hydraulic cylinder 1, so sum of the leftward pressures exerting on the right sides of the left and right pistons 54 55 in the second and third accumulator cylinders 57 58 is less than the rightward pressure exerting on the left side of the left piston 54 in the first accumulator sub-chamber 56, so the balance is broken off, the pistons 54 55 are moved to the right to assist water in the second and third accumulator sub-chambers 57 58 with draining out until running out.

Figure 5:
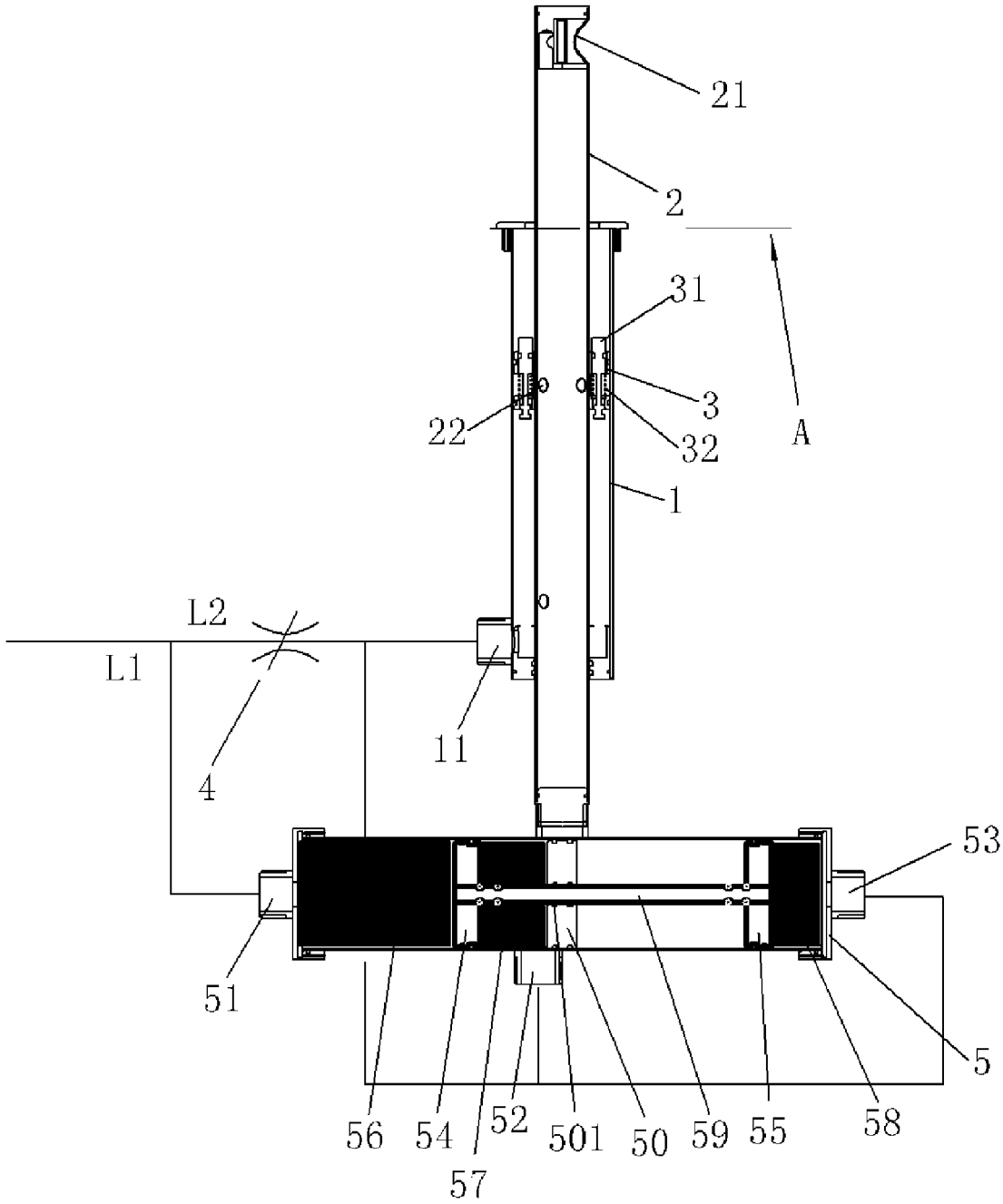
FIG. 5 is a cross-section view showing the falling down state of the present invention.

Tending to stop use, as showing in FIG. 5, when turning off the gate of the inlet pipe, in the hydraulic cylinder 1, the water pressure exerting on the lifting piston 3 and the frictions are less than said weight, so the lifting facet 2 goes down under the weight force automatically until fully hiding under the working top A getting into home position; during going down, when the pressure valve 31 is departed with the top end of the hydraulic cylinder 1, it is pushed up by the restoring spring 32 to block the inlet 22 to communicate to the hydraulic cylinder 1 again, so the faucet 2 is cut off without water flowing out; meanwhile, the water at inside of the hydraulic cylinder 1 is pushed into the second and the third accumulator sub-chambers 57 58, in the accumulator cylinder 5, the increased water pressures in the second and the third accumulator sub-chambers 57 58 push the left and right pistons 54 55 leftward as it is bigger than sum of the water pressure in the first accumulator sub-chamber 56 rightward and other rightward extra forces, so that the first accumulator sub-chamber 56 starts to drain water, the drained water from the first accumulator sub-chamber 56 is led into the second and the third accumulator sub-chambers 57 58 via the pressure release valve 4, and they are accumulated water until the lifting faucet 2 gets into the home position, the all system is gone back to the original state.

Therefore, by means of the hydraulic cylinder 1, the accumulator cylinder 5, the pressure release valve 4 and water pressure, the faucet 2 hidden under the working top A provided by the present invention can carry out automatic lifting up and falling down, so as to get in lifting up in using time, and falling down in idle time functions, not only facilitating to using, but also saving occupied space. Additionally, water in the whole system is circled without any pollution occurred.

By way of explanation, "left, right, the first, the second, the third" words appearing in the description are just used for describe the relative position facilitating to cooperating to the drawings, but not defining absolute detail position.

I claim:

1. An automatic lift faucet, comprising:

a hydraulic cylinder, said hydraulic cylinder being vertically mounted under a working top and having a lower end and an upper end and a through-hole axially penetrating both ends, and an inlet located proximate to said lower end;

a lifting faucet having a top end, a closed bottom end and a middle portion therebetween, said lifting faucet being mounted inside said hydraulic cylinder in motion fitting connection and having an outlet located at said top end and an inlet located on said middle portion;

a lifting piston being attached to said lifting faucet and surrounding said inlet thereof and having a pressure valve and a restoring spring for controlling fluid communication between said hydraulic cylinder and said lifting faucet inlet;

an accumulator cylinder being horizontally mounted below said working top to said bottom end of said lifting faucet, said accumulator cylinder having a trunk defining a left end, a right end and a middle portion therebetween, said accumulator cylinder including a baffle-plate, a valve stem having left and right ends, and left and right tow pistons, wherein said baffle-plate is centrally attached within said middle portion of said trunk, said baffle plate having a central hole through which said valve stem passes, said left and right tow pistons being attached to said left and right ends of said valve stem respectively, thereby dividing the inside of said accumulator cylinder into a first accumulator sub-chamber between said left end of said trunk and said left tow piston, a second accumulator sub-chamber between said left tow piston and said baffle plate, and a third accumulator sub-chamber between said right tow piston and said right end of said trunk, said accumulator cylinder further including first, second and third through-holes, said first through-hole passing through said left end of said trunk and communicating with said first accumulator sub-chamber, said second through-hole passing through said middle portion of said trunk and communicating with said second accumulator sub-chamber, and said third through-hole passing through said right end of said trunk and communicating with said third accumulator sub-chamber; and an inlet pipe and pressure release valve, wherein said inlet pipe includes a first branch pipe and a second branch pipe, said first branch pipe being connected to said first through-hole, and said second branch pipe being indirectly connected to said second and third through-holes and said inlet of said hydraulic cylinder via said pressure release valve, respectively.

2. The automatic lift faucet as claimed in claim 1, wherein said accumulator cylinder fixed on said bottom end of said lifting faucet functions as a balance weight for said lifting faucet.

* * * * *